US005253572A

United States Patent [19]

Uehara et al.

[11] Patent Number: 5,253,572

[45] Date of Patent: Oct. 19, 1993

[54] PRESS WITH INDEPENDENT CONTROLS FOR RECIPROCATION OF AND PRESSURE APPLICATION BY RAM

[75] Inventors: Tadayoshi Uehara; Toshio Suzuki, both of Sagamihara, Japan

[73] Assignee: Aida Engineering, Ltd., Kanagawa, Japan

[21] Appl. No.: 943,245

[22] Filed: Sep. 11, 1992

[30] Foreign Application Priority Data

Sep. 24, 1991 [JP] Japan ..... 3-243715

[51] Int. Cl.[5] ..... B30B 15/14; B30B 15/16

[52] U.S. Cl. ..... 100/48; 100/99; 100/271; 72/21; 72/453.04

[58] Field of Search ..... 100/48, 43, 231, 99, 100/270-272, 282, 283; 72/21, 443, 450, 451, 453.03, 453.04

[56] References Cited

U.S. PATENT DOCUMENTS

| | | | |
|---|---|---|---|
| 905,601 | 12/1908 | Sperber | 100/272 X |
| 933,010 | 8/1909 | Wilzin | 100/271 X |
| 1,007,792 | 11/1911 | Orton | 72/453.04 X |
| 2,633,094 | 3/1953 | Muller | 100/272 X |
| 3,143,007 | 8/1964 | Thompson | 72/453.03 |
| 3,518,869 | 7/1970 | Forichon | 100/272 X |
| 3,561,252 | 2/1971 | Norton et al. | 100/231 X |
| 4,480,538 | 11/1984 | Yoshida | 100/48 |

FOREIGN PATENT DOCUMENTS

| | | | |
|---|---|---|---|
| 3507327 | 9/1986 | Fed. Rep. of Germany | 100/270 |
| 61-169200 | 7/1986 | Japan | 100/99 |
| 464696 | 12/1968 | Switzerland | 100/272 |
| 617295 | 7/1978 | U.S.S.R. | 100/270 |
| 439126 | 3/1979 | U.S.S.R. | 100/282 |
| 1263538 | 10/1986 | U.S.S.R. | 100/231 |

*Primary Examiner*—Stephen F. Gerrity
*Attorney, Agent, or Firm*—Steven M. Rabin

[57] ABSTRACT

A press includes a reciprocation unit having a crank structure which is driven in horizontal reciprocation by an associated press drive. A motion direction shifting unit having a link structure is coupled to the reciprocation unit a ram so as to reciprocate the ram vertically between an upper position and a lower rest position in response to the horizontal reciprocation of the reciprocation unit, such that the ram remains in a state of substantial rest with respect to the shifting unit for a predetermined period of time upon reaching the lower position. A control unit controls a hydraulic fluid supply system to cause a pressure applying device to apply a controlled press forming force to the ram when a sensor detects that the ram is in the rest state.

20 Claims, 6 Drawing Sheets

PRESS WITH INDEPENDENT CONTROLS FOR RECIPROCATION OF AND PRESSURE APPLICATION BY RAM

BACKGROUND OF THE INVENTION

The invention relates to a press capable of pressing articles with high accuracy (within close tolerances) and at a high rate.

A typical conventional press is schematically illustrated in FIG. 7. Such a press includes a main body 100 and a stroke generating unit 110. The main body 100 comprises an upper die 103 mounted to a ram 101 and a lower die 104 mounted to a bolster 105 located on a bed 106. Pressing is performed by causing the ram 101 to make an up-and-down stroke. Reference numeral 102 is a slide guide gib for the ram 101.

The stroke generating unit 110 includes a crankshaft 111 having an eccentric member 112. The crankshaft is rotatably mounted in a bearing 113. The eccentric member 112 is connected to the ram 101 via a connecting rod 114. The crankshaft 111 is coupled with a flywheel 115 which is connected via a belt 117 to a motor 116. The drive power of the motor 116 is transmitted to the crankshaft 111 after being stored in the flywheel 115. A clutch/brake means not shown in the drawing is interposed between the flywheel 115 and the crankshaft 111.

An effective step, generally believed to improve the accuracy with which articles are produced by the press, is to reduce the shock at the start of pressing and slow the downward speed thereafter. However, this could have an adverse effect of increasing the period of each cycle of the press, resulting in a lower productivity. Also, considering technical properties peculiar to the press, it is impossible to vary the rotational frequency of the crankshaft from the flywheel side.

Therefore, various improvements have been made to a reciprocation mechanism so as to speed up most of the vertical stroke of the ram and make the ram as slow as possible at the time of pressing. But the achievements which can be obtained with such improvements of the reciprocation mechanism, are limited as will be described below.

Under these circumstances, there has been proposed a press, illustrated in FIG. 8, that is equipped with a power generating unit 120 whose crankshaft 111 can be rotated at a variable frequency. The power generating unit 120 comprises a cylinder unit 123 having a cylinder 124 and a piston 125, rotatably supported via a rod 121 in a bearing 122. The cylinder unit 123 has a piston rod 126 connected via a link rod 127 to the crankshaft 111. Pressurized oil from a pump 129 driven by a motor 128 is supplied to the cylinder unit 123 with use of an electromagnetic valve 130, etc. for controlling the speed of the piston rod 126. A flywheel is indicated by the reference number 131. With this mechanism, it would be possible to ease the shock at the start of pressing and change the pressing speed as well.

However, due to inherent properties of the cylinder, it is actually impossible to achieve high speed in one part of the stroke and low speed in another part, as well as to achieve a desired rate of change of speed in respective parts. Therefore, the press shown in FIG. 8 cannot satisfy both the requirement of a high accuracy and the requirement of a high-speed operating cycle, but only one should be selected. With this press, it is difficult to obtain a smooth stroke of the ram. Connection and automation of fittings are also difficult.

Both presses shown in FIGS. 7 and 8 generate a press forming force with use of a reciprocation mechanism. However, according to numerous analyses performed by the present inventors, the reciprocation mechanism has an inherent characteristic which seems to prevent operations at a very high accuracy. In particular, press forming starts when the connecting rod 114 is inclined with respect to the vertical axis at an angle $\alpha$ shown in FIG. 9 (e.g. 5 to 7 degrees). Therefore, upon application on a press forming force F, which is the vertical load, there occurs a large horizontal thrust T equal to F tan $\alpha$. Thus, even if the gib 102 has a strong and tough structure, the lower surface of the ram slants and slides sideways, thereby resulting in decreased pressing accuracy. Further, the thrust load T will damage dies and products and impede a smooth stroke of the ram 101.

SUMMARY OF THE INVENTION

It is therefore an object of the invention to provide a press which can produce articles with high accuracy while using a high-speed pressing cycle.

The invention has been made in consideration of the following determination described above: Technical problems of conventional presses are attributable to the fact that the downward movement of the ram from the top dead center to a position at which an upper die contacts material to be worked, and the generation of a press forming force to be applied to the material, are carried out by the same reciprocation mechanism. It is difficult for a hydraulic cylinder unit of the press to maintain good control of the displacement and speed of the ram for the full duration of its lengthy stroke. Such control is reliable within only a limited, small portion of the stroke. The inventors have recognized this and so, according to one aspect of the invention, the ram is displaced downward by two independently powered mechanical structures. Initially, the ram is lowered by a mechanical structure which includes a reciprocation mechanism capable of operating at high-speed and with smooth movement. Then, while the ram is held stationary with respect to the reciprocation mechanism, at bottom dead center, the ram is pushed downward at a controlled speed by a press forming force from another mechanical structure such as a hydraulic cylinder unit.

The press according to the invention comprises a ram and a vertical motion device. The vertical motion device includes a press drive, a reciprocation unit associated with the press drive to be driven in horizontal reciprocation, and a motion direction shifting unit. The shifting unit is coupled to the reciprocation unit and the ram so as to reciprocate the ram vertically between an upper position and a lower rest position in response to horizontal reciprocation of the reciprocation unit. The shifting unit and the reciprocation unit are coupled and arranged so that that the ram remains in a state of substantial rest with respect to the shifting unit for a period of time upon reaching the rest position. A pressure applying device, suitably a hydraulic cylinder unit, is provided for pushing the ram downward during said period of time. A sensor means is provided for detecting that the ram is in the rest state, and a pressure drive/-control means is provided for driving the pressure applying device to apply a controlled press forming force to the ram when the sensor means detects that the ram is in the rest state.

Further, according to the invention, the shifting unit has a link structure and the reciprocation unit has a crank structure. The shifting unit has upper and lower links rotatably connected by a connection pin. The upper and lower links are connected by further connection pins to a piston of the hydraulic cylinder unit and to the ram, respectively. The pin connecting together the upper and lower links is mounted for vertical movement within a vertical guide frame of a slider, the slider being mounted to a press frame for horizontal reciprocal movement. The reciprocation unit has a connecting rod provided on an eccentric member of a crankshaft. The crankshaft rotates in synchronism with the press drive. The connecting rod is connected to the slider so as to reciprocate the latter horizontally.

When the reciprocation unit is operating, the upper and lower links are caused to rotate relative to each other about their connection pin. Because the upper link is pivotally supported on the hydraulic cylinder unit, the ram, pivotally supported by the lower link, is moved up and down. Therefore, the vertical motion device lifts and lowers the ram at a high speed.

From a time when the ram completes its downward motion relative to the shifting unit to a time where it starts an upward motion, the two links are in a substantially vertically straight condition so that despite continued rotation of the press drive, the ram is substantially stationary in relation to the shifting unit. When the posture sensor means detects such a straight condition of the links, the drive/control means operates to cause the hydraulic cylinder unit to apply a downward force on the substantially vertically aligned links to push the ram down. Thus, the press forming force is applied to the ram via the upper and lower links. After the application of a press forming force has been completed, hydraulic pressure is released from the hydraulic cylinder unit until the ram starts its upward motion. Thereafter, the ram is lifted at a high speed by the vertical motion device, aided initially by the hydraulic cylinder unit.

If the drive/control means is appropriately set to drive the ram, it is possible to move the ram up and down at a high speed but perform a press forming operation at a low speed, thereby enabling high-speed reciprocation operations and highly accurate press forming. The improved accuracy of press forming is also a result of reduced horizontal thrust. Moreover, the reduced horizontal thrust permits a simplification of the mechanical structure.

Further, when the slider is reciprocated horizontally by the reciprocation unit, the fulcrum (connection pin) for the upper and lower links is displaced horizontally with, and vertically in, the slider, which imparts a vertical motion to the ram. Therefore, the invention further improves the smooth operation of the reciprocation unit and the efficiency of transmission of the press forming force by the pressure applying device.

Thus, the press of the invention is provided with a vertical motion device including a motion direction shifting unit and a reciprocation unit, wherein the shifting unit has upper and lower links, the pressure applying device includes a hydraulic cylinder, and the drive/control means serves to provide cooperation between the pressure applying device and the vertical motion device. The press forming force is applied to the ram when it completes in its high-speed downward motion and is at rest with the links substantially aligned in a straight condition. As so constituted, the invention provides the following advantageous effects.

High-speed reciprocation of the ram and highly accurate press forming are both attainable because the vertical motion device for lifting and lowering the ram at a high speed, and the pressure applying device for imparting the press forming force, act separately and independently.

As the press forming force is applied by the pressure applying device when a pair of the upper and lower links come into a substantially vertical alignment, it is possible to minimize the horizontal thrust and prevent the ram from slanting and sliding. The accuracy of press forming therefore can be improved further and at the same time the guide gib for the ram can have a simple structure and can be manufactured at low cost.

Further, the pressure applying device may act to move the ram only in a short stroke at the time of press forming, and not for the entire downward stroke. It is therefore possible to lower the ram for press forming with great precision at a desired rate of change. This further enables highly accurate press forming to be effected.

Still further, because the reciprocation unit of the vertical motion device and the press drive, including a motor, operate only to move the ram vertically under no-load conditions, without a necessity to generate the pressing force, the press of the invention can be smaller in size, lower in rigidity, and manufactured at a lower cost than can be prior presses intended for comparable use. Moreover, since the vertical motion of the ram is performed by a mechanical structure including a reciprocation unit, the invention can ensure and facilitate an association with attachments and automation thereof. In addition, because the relation between the vertical motion device and the pressure applying device can be harmonized by a drive/control means, with which the timing of operations is also changeable, the invention has a wider application by providing a capability to emphasize further either the speed of operation or the accuracy of press forming.

BRIEF DESCRIPTION OF THE DRAWINGS

These and other features and advantages of the invention will be further understood from the following detailed description of the preferred embodiment with reference to the accompanying drawings in which.

DETAILED DESCRIPTION OF THE PREFERRED EMBODIMENT

Figure 1:
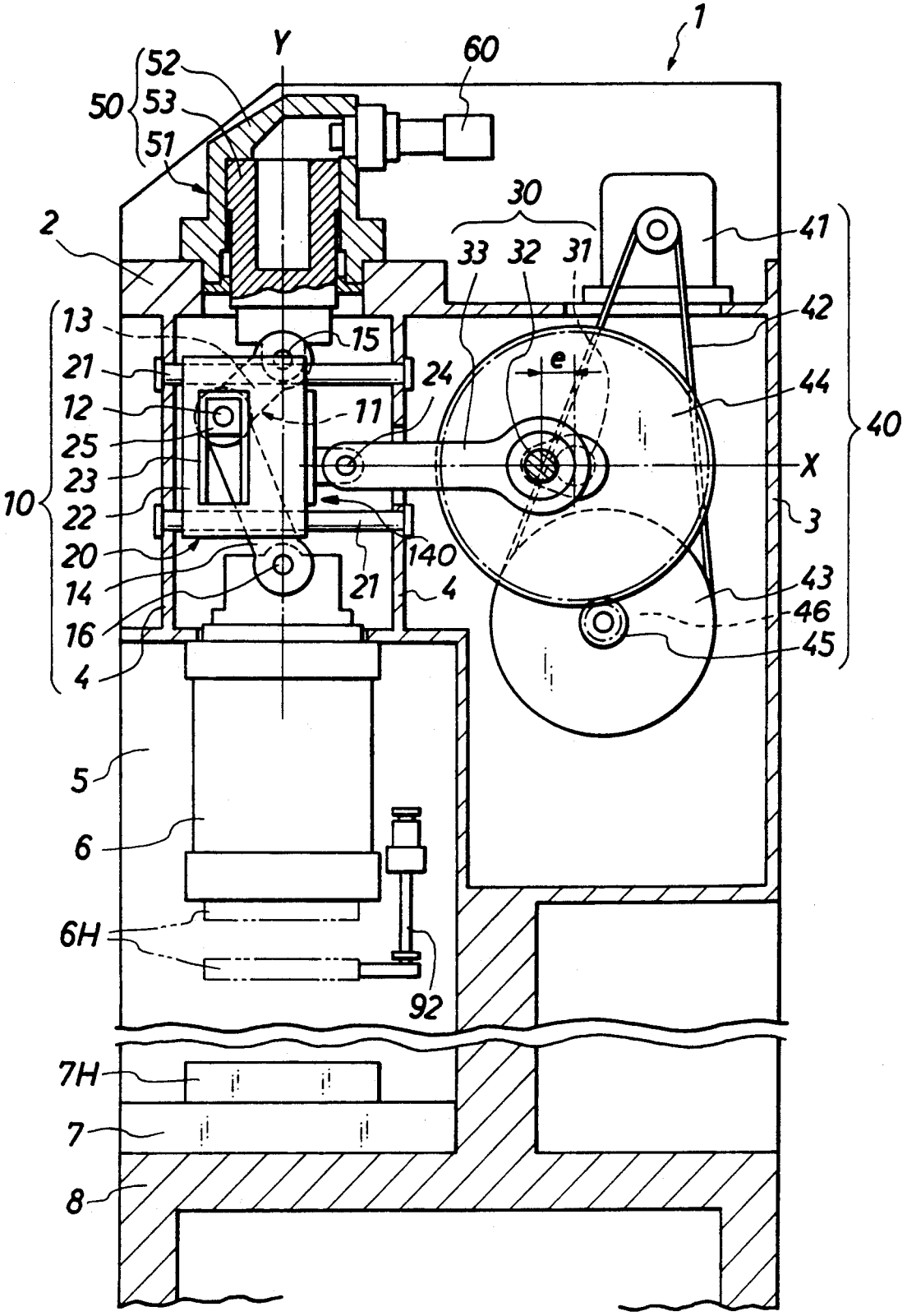
FIG. 1 is a sectional view of an entire press assembly according to the preferred embodiment of the invention.
Figure 2:
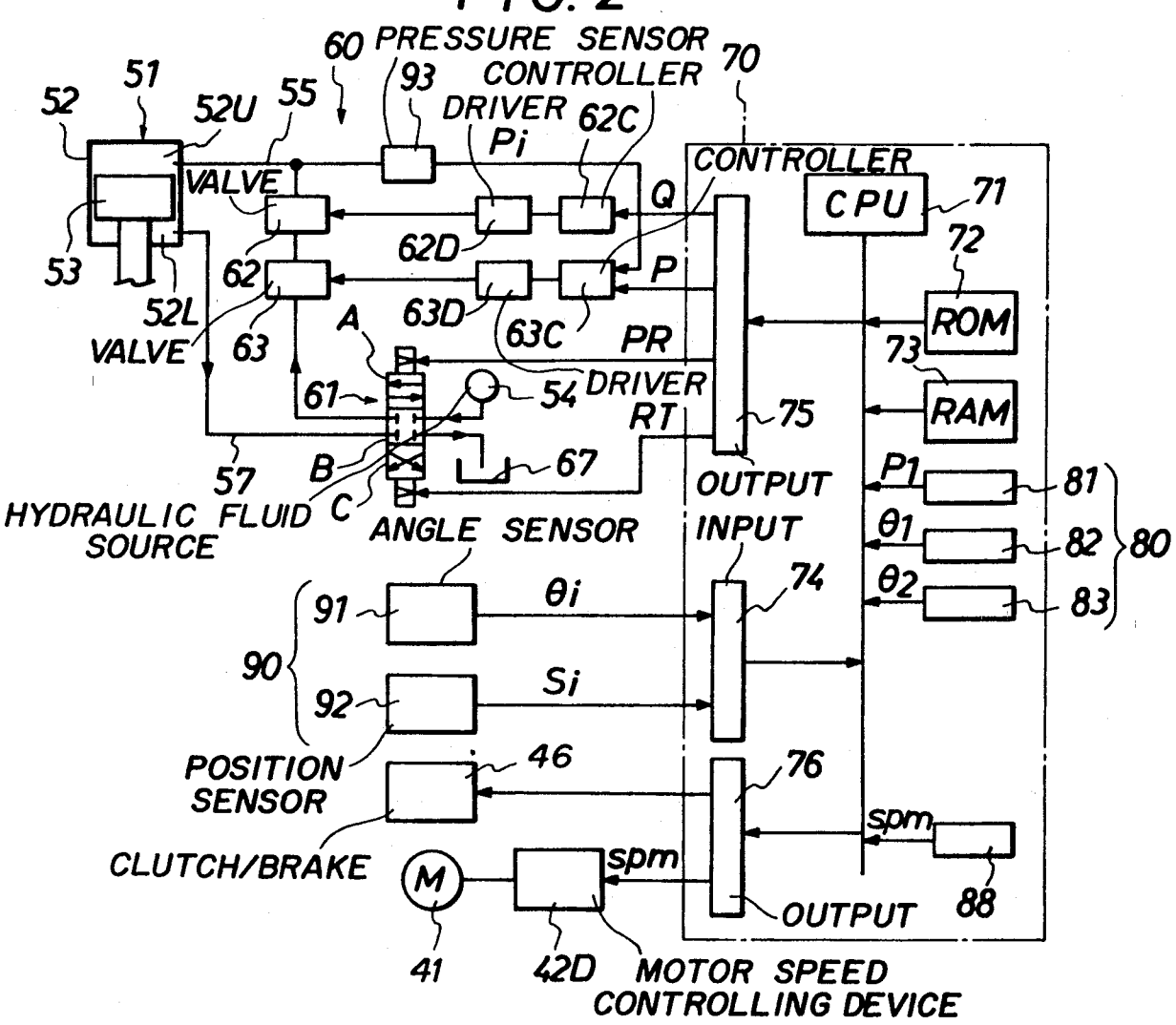
FIG. 2 is a block diagram showing the electronic, electric and hydraulic elements of the preferred embodiment.

As shown in FIGS. 1 and 2, the press of the invention comprises a vertical motion device 10, a pressure applying device 50 and a pressure drive/control means 60. The vertical motion of a press ram between top dead center and a position immediately above a position where the ram starts press forming, is carried out at high speed by the vertical motion device 10. Press forming is conducted by application of a press forming force to the vertical motion device 10 with the pressure applying device 50 and the pressure drive/control means 60.

In FIG. 1, a press main body 1 comprises a ram 6 for carrying an upper die 6H. The ram 6 is vertically slideably guided by a gib (not shown) mounted to a frame 5. A bolster 7 for holding a lower die 7H is disposed on a bed 8. An upper portion of the frame 5 includes a housing 3 for the vertical motion device 10. Above the housing 3 is an upper frame 2 which supports the pressure applying device 50.

The vertical motion device 10 includes a motion direction shifting unit 140 and a reciprocation unit 30. In the preferred embodiment, the vertical motion device 10 is constructed as a knuckle joint having a link structure and a crank structure.

The motion direction shifting unit 140 converts a horizontal motion of the reciprocation unit 30 to a vertical motion for moving the ram 6 up and down. The shifting unit 140 comprises a link structure 11, and a fulcrum guide unit 20 connecting the link structure to the reciprocation unit 30. The link structure 11 includes an upper link 13, a lower link 14, and a connection pin 12 rotatably or pivotally connecting the links together.

The upper link 13 is pivotally connected by a pin 15 to the pressure applying device 50. The lower link 14 is pivotally connected by a pin 16 to the ram 6. Therefore the upper and lower links, 13 and 14, are mutually connected for relative rotation about the connection pin 12 (acting as a fulcrum) so that, if a part to which the pin 15 is mounted (i.e. the pressure applying device 50) is stationary, horizontal lateral motion of the pin 12 will force the ram 6 into an up-and-down motion via relative rotation of the upper and lower links, 13 and 14.

Horizontal motion is imparted to the shifting unit 140 by the reciprocation unit 30, which has a crank structure in the preferred embodiment. The reciprocation unit 30 includes a connecting rod 33. The connecting rod 33 is not directly connected to the connection pin 12, but is connected indirectly via the fulcrum guide unit 20.

The fulcrum guide unit 20 includes a pair of horizontal guide bars 21. The guide bars 21 are disposed at upper and lower positions of a pair of support plate members 4 provided respectively toward the front and the back of the press. The unit 20 also includes a slider 22 slideably mounted to the guide bars 21, a vertical guide frame 23 provided in the slider 22, and a sliding element 25 slideably mounted in the guide frame 23. The slider 22 and the connecting rod 33 are pivotally connected by a pin 24. The pin 12 connecting the links 13 and 14 is slideably mounted within the guide frame 23 via the sliding element 25. Therefore, as the slider 22 moves in a horizontal direction, the pin 12 follows while being permitted to move in a vertical direction as well.

The reciprocation unit 30 also includes a crankshaft 31 having an eccentric member 32 (of eccentricity "e"), to which the connecting rod 33 is rotatably mounted. The unit 30 is driven by a press drive 40 which comprises a flywheel 43 having a clutch/brake means 46 therein. The flywheel is connected by a belt 42 to a motor 41 disposed on the upper frame 2 of the press main body 1. A pinion 45 engages with a main gear 44 that is coaxial with the crankshaft 31. The drive power of the motor 41 is stored in the flywheel 43 and is fed to rotate the crankshaft 31 by operation of the clutch/-brake means 46. Thus, with the vertical motion device 10, the horizontal motion of the connecting rod 33 generated from the rotation of the crankshaft 31 can be converted to vertical motion of the ram 6.

According to the invention, the ram 6 is movable up and down at a high speed between the top dead center and the starting position for press forming. Moreover, as the ram approaches the starting position for a press forming operation, it slows and comes to a halt. Since the vertical motion device 10 has a mechanical construction, the up-and-down motion of the ram is smooth and stabilized, thereby facilitating automation of the press operations, including association with other attachments.

Figure 4:
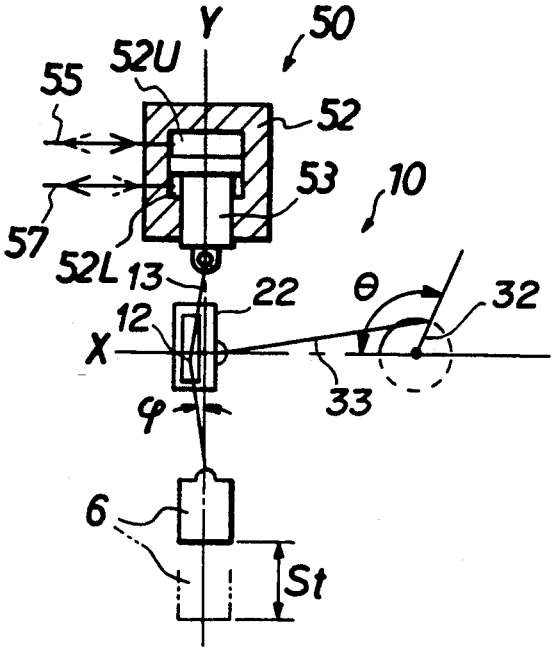
FIG. 4 is a schematic view for use in explaining the operation.
Figure 5:
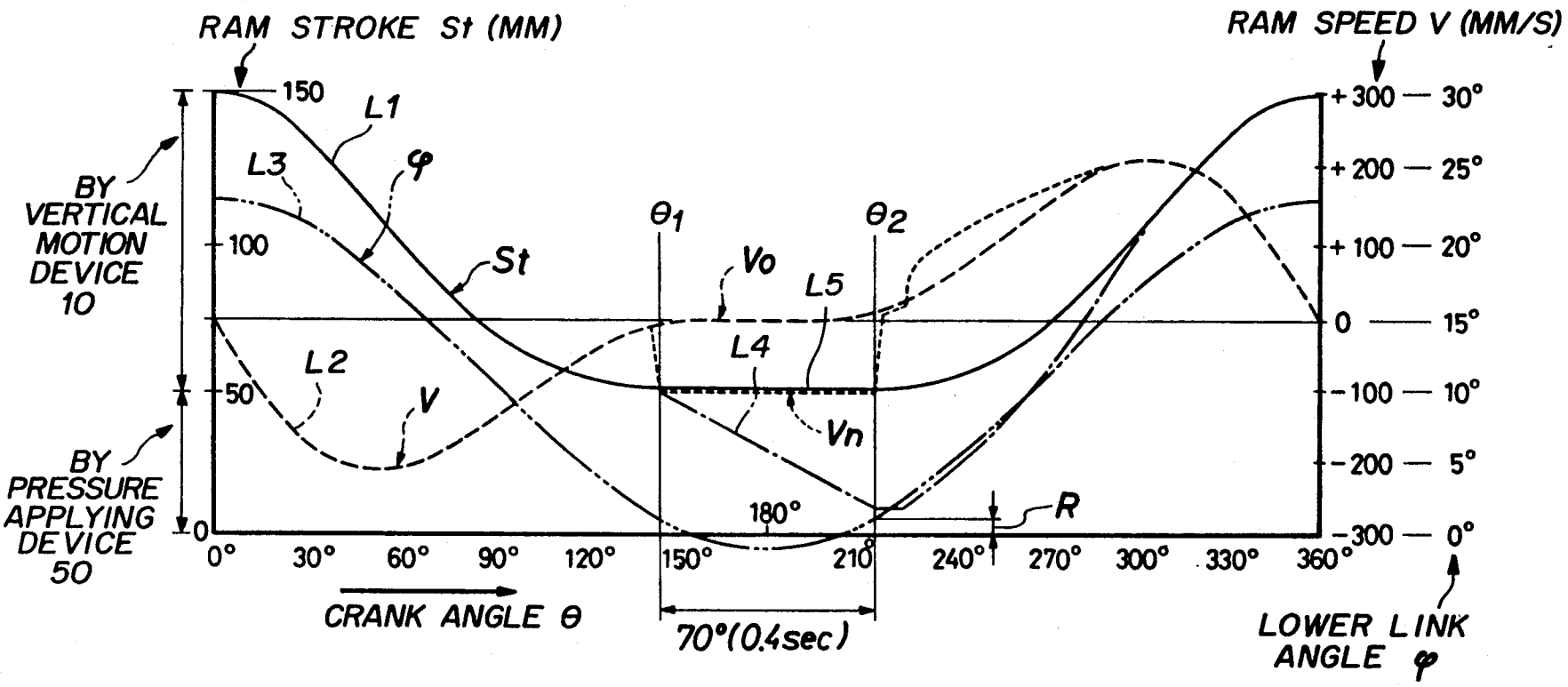
FIG. 5 is a timing chart.

Operation of the vertical motion device 10 is now described in detail with reference to FIGS. 4 and 5. In FIG. 4 is shown in relation to the parts of the device 10, a vertical axis Y, a horizontal axis X, a lower link angle $\phi$ (which is the angle between the vertical axis Y and the lower link 14), and a crank angle $\theta$. The relations among ram stroke St, the ram speed (V, $V_n$, $V_O$), the lower link angle $\phi$, and the crank angle $\theta$ are shown in FIG. 5.

The press ram makes a downward motion when the crank angle $\theta$ is between 0 and 145 degrees, during which the ram speed V varies sinusoidally with values from 0 to −200 mm/s (a negative value means a descending motion). When the crank angle $\theta$ is between 215 and 360 degrees, the ram 6 makes an upward motion during which the ram speed V again varies sinusoidally, now with values from 0 to +200 mm/s. Thus, the ram moves up and down at a high speed. The ram stroke St in this embodiment is 100 mm (from a 150 mm level to a 50 mm level).

However, while the crank angle $\theta$ is between 145 and 215 degrees, the ram speed relative to the pressure applying device 50 ($V_O$) becomes almost zero mm/s and the position of the ram 6 (the ram stroke St) experiences almost no change, that is, the ram remains stationary. In case of a reciprocation of the ram at 30 spm (strokes per minute), the ram remains at rest for 0.4 sec.

Figure 6:
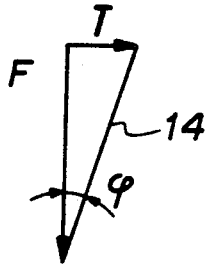
FIG. 6 is a force diagram according to the invention.
Figure 9:
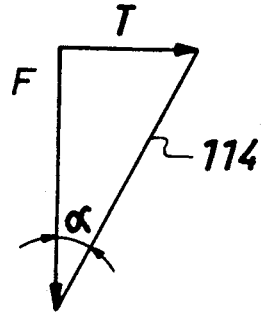
FIG. 9 PRIOR ART
FIG. 9 is a force diagram according to the prior art.
Figure 7:
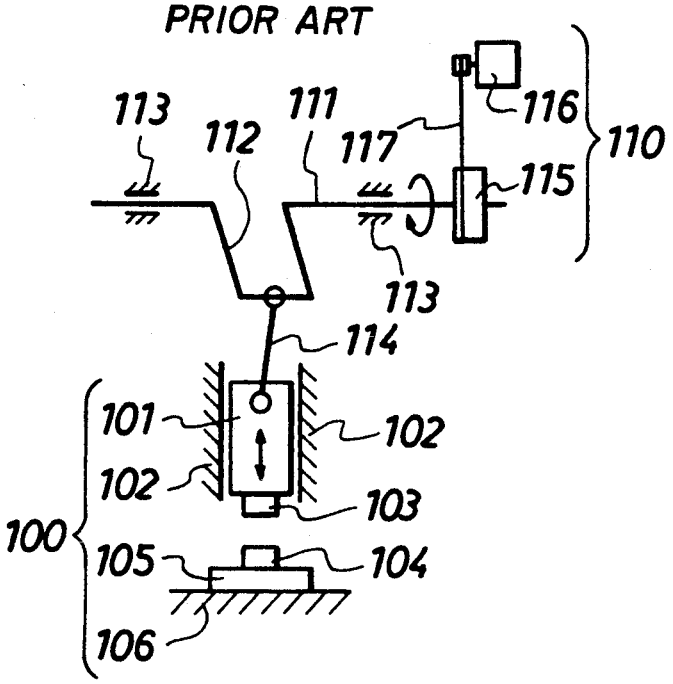
FIG. 7 PRIOR ART
FIG. 7 is a schematic view of a press of the prior art.
Figure 8:
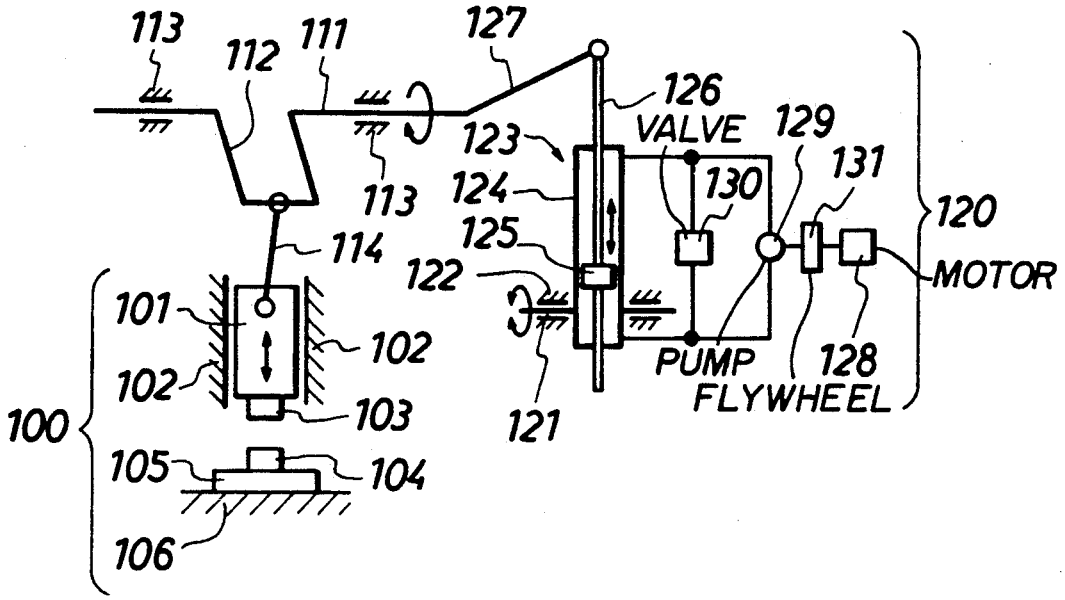
FIG. 8 PRIOR ART
FIG. 8 is a schematic view of another press of the prior art.

When the ram is at rest relative to the pressure applying device 50, with the crank angle $\theta$ at 145 to 215 degrees, the angle of inclination $\phi$ for the lower link 14 is limited in the range $-1.3° \leqq \theta \leqq 1.3°$. therefore, if press forming is performed during this resting period of the ram, the horizontal thrust T as shown in FIG. 6 will not exceed about 2% of the press forming force F ($T = F \cdot \tan \phi = 0.02 \cdot F$). By comparison, the horizontal thrust (FIG. 9) produced by prior art presses of the type illustrated in FIGS. 7 and 8, wherein the angle of inclination $\phi$ of the connecting rod 114 is between 5° and 7°, would be much higher (between 0.087·F and 125·F). Thus, the invention can reduce the horizontal thrust T to a large extent with the effect that the accuracy of press forming is remarkably improved.

Another technical characteristic of the invention enables press forming to be effected during the resting period of the ram. This is attainable by the cooperation between the pressure applying device 50 and the drive/-control means 60. As shown in FIGS. 1 and 2, the pressure applying device 50 includes a hydraulic cylinder unit 51 and a hydraulic fluid supply system. The unit 51, attached to the upper frame 2 of the press main body 1, includes a cylinder 52 and a piston 53 slideably fitted in the cylinder. The hydraulic fluid supply system comprises a hydraulic fluid source 54 and pipes 55 and 57. In the illustrated embodiment, the hydraulic cylinder unit 51 has an effective stroke of 0 to 5 mm.

As shown in FIGS. 2 and 4, the cylinder 52 has upper and lower chambers, 52U and 52L, respectively connected with the pipes 55 and 57. During press forming, the pipe 55 serves to supply hydraulic fluid (oil) pressure to the upper chamber 52U, and The pipe 57, leading to a sump 67, serves to release oil from the lower chamber 52L. The direction of oil flow into and out of the hydraulic cylinder unit 51 is controlled by a three-port, electromagnetically driven selector valve 61 constituting a part of the drive/control means 60.

The drive/control means 60 operates the pressure applying device 50 during the resting period of the ram also by controlling the hydraulic pressure during that period with a flow regulating valve 62 and a pressure regulating valve 63. An electronic control unit 70 controls the valves 61, 62 and 63 in response to pressure and crank angle values set in a setting unit 80 and crank angle and ram position values detected by a posture sensor unit 90, as will be described below.

As described above, when the ram remains at rest, the links 13 and 14 stay in a substantially straight (i.e., collinear) condition along the vertical axis Y, with only a small angle of inclination $\phi$. Upon a detection of this condition, the piston 53 of the pressure applying device 50, and consequently the press ram 6, are controlled to move at a desired rate of change of speed so as to effect press forming with high accuracy. That is, the drive/-control means 60 acts to operate the vertical motion device 10 and the pressure applying device 50 in cooperation.

Conventional presses cannot provide both high-speed cyclical operations and highly accurate press forming because the energy and parts movements for raising and lowering the ram, and those for applying a press forming force to the ram, are generated, in such conventional presses, by one mechanism. In contrast, according to the invention, the vertical motion device 10 for reciprocating the ram up and down, and the pressure applying device 50 for performing press forming operations, are separate and independent of each other, but they are adapted to work in cooperation so as to attain their predetermined purposes.

The structure and operation of the drive/control means 60 will now be described in more detail with reference to FIG. 2. In this embodiment, the pressure regulating valve 63 is operable by a controller 63C and its driver 63D. The controller 63C receives a pressure setpoint signal P from the control unit 70 and a feedback signal $P_i$ from an oil pressure sensor 93 (the sensor 93 detects the oil pressure inside the hydraulic cylinder unit 51). Through the driver 63D, the controller 63C controls the pressure regulating valve 63 to regulate the oil pressure from the source 54 so as to maintain the oil pressure at a constant value. However, in an embodiment in which the source 54 provides a constant oil pressure, the pressure regulating valve 63 and associated controller and driver may be omitted.

The speed at which the ram is pushed downward during press forming to distort the material being pressed (hereinafter "distortion speed") is controlled by automatic adjustment of the flow regulating valve 62. A controller 62C receives a flow setpoint signal Q from the control unit 70, and through an associated driver 62D, controls the flow regulating valve 62 so as to regulate the oil flow through the pipe 55 into the upper chamber 52U of the cylinder 52.

In this embodiment, a distortion speed curve, selected for high accuracy processing, is stored in a ROM 72 (or RAM 73) of the control unit 70. Such a distortion speed curve is illustrated by the single dot chain line L4 in FIG. 5. The ROM (or RAM) outputs the flow setpoint signal Q corresponding to this curve and sends it to the controller 62C for control of the flow regulating valve 62, thereby attaining a desired rate of change in ram speed during the press forming operation. According to this embodiment, the rate of change in flow within the hydraulic cylinder unit 51 to lower the ram 6 according the curve L4 shown in FIG. 5, is controlled by the flow setpoint signal Q from the control unit 70. However, such rate alternatively may be set in the controller 62C.

The flow setpoint signal Q from the control unit 70 is directly emitted on the basis of the distortion speed curve stored in the ROM 72 or RAM 73. However, greater accuracy may be sought for the flow setpoint signal Q by comparing the setpoint of the distortion speed curve with feedback which indicates the actual rate of change of position of the ram 6. Such feedback can be obtained by differentiating in a CPU 71 of the control unit 70 positional data (the signal $S_i$) from a ram position sensor 92. Further, the control unit 70 may be so constructed that the positional data (signal $S_i$) is fed back to the controller 62C rather than being compared in the control unit 70 to the curve stored in the ROM or RAM.

Figure 3:
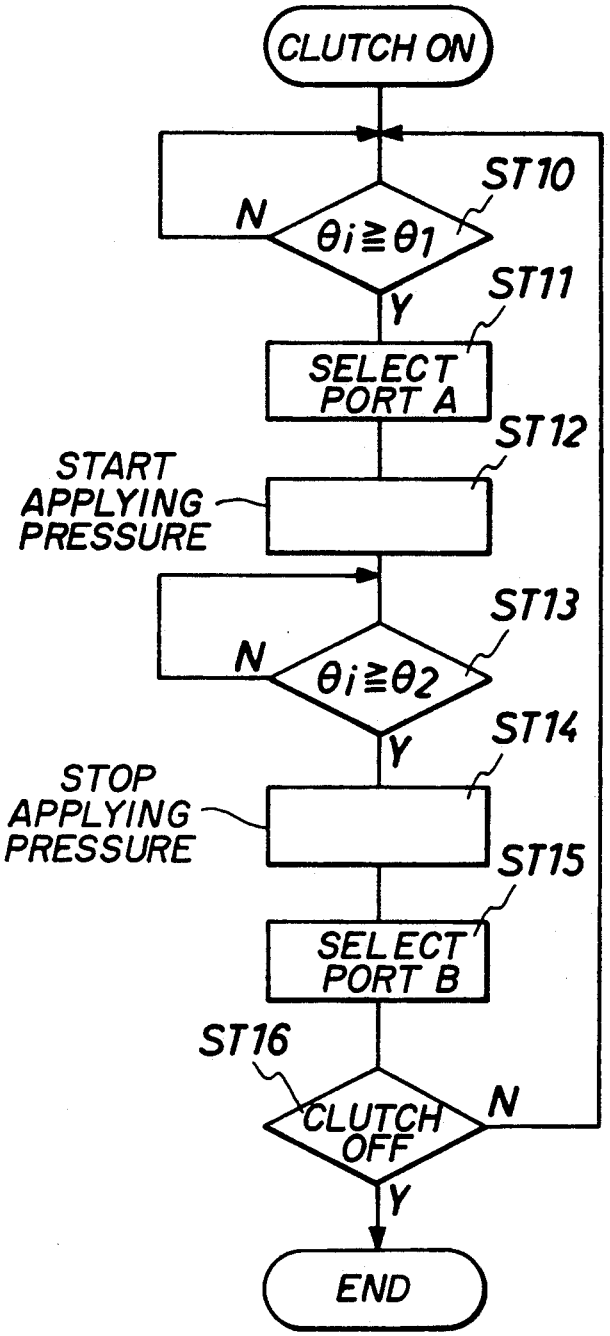
FIG. 3 is a flow chart for explaining control operations according to the invention.

The control unit 70, as shown in FIG. 2, comprises, in addition to the CPU 71, ROM 72 and RAM 73, an input port 74 and output ports 75 and 76. The CPU 71 performs calculations, issues commands, executes programs, etc. The ROM 72 stores, in addition to the distortion curve, a press-forming program whose flow diagram is illustrated in FIG. 3, and other various programs and fixed data. The RAM 73 temporarily stores data such as the detected crank angle $\theta_i$ and the ram position $S_i$, etc. The control unit 70 of the preferred embodiment is composed of a microprocessor.

With the press clutch (46) ON, the CPU 71 executes the press-forming program stored in the ROM 72, in order to provide cooperative control over the vertical motion device 10 and the pressure applying device 50. In detail, when the ram 6 reaches the resting position (where the crank angle $\theta$ is between 145° ($\theta_1$) and 215° ($\theta_2$)) as shown in FIG. 5 (step ST10 of FIG. 3), a signal PR is output by the control unit 70 to the selector valve 61. The three ports of the selector valve 61 include a port A which, when selected, connects the hydraulic fluid source 54 to the upper chamber 52U of the cylinder 52 via the control valves 62 and 63. In response to the signal PR, the selector valve 61 selects the port A (step ST11). Then, by controlling the flow regulating valve 62, the pressure applying device 50 is caused to apply a controlled pressure, through the now stationary crank structure 11, to the ram 6 (step ST12). At the end of the press forming process (step ST13), the pressure applying device 50, by control of the valve 62, stops pressure application (step ST14). A signal RT is then output by the control unit 70 to the selector valve 61 which selects another of its three ports, a port B (step ST15). Port B blocks communication between the hydraulic fluid source 54 and the pipes 55 and 57 leading to the cylinder 52. The above steps (ST10 to ST15) are repeated (step ST16) until the press clutch is turned OFF.

The cooperation between the setting unit 80 and the posture sensor unit 90 enables the steps ST10 to ST13 to be performed automatically. The setting unit 80 sets values governing the timing and level of hydraulic pressure to be applied to the pressure applying device 50. The setting unit 80 comprises a pressure setting means 81 by which the pressure setpoint signal P (to be applied to the controller 63C) is set, a start angle setting means 82 for setting the crank angle $\theta_1$ at which the hydraulic pressure application starts, and a stop angle setting means 83 for setting the angle crank $\theta_2$ at which such hydraulic pressure application is discontinued. The angles $\theta_1$ and $\theta_2$ are normally set at values determined to define the boundaries of the resting period of the ram during which the upper and lower links, 13 and 14, stay in a substantially straight posture, for example at $\pm 1.3°$. The means 82 and 83 set the timing for driving the hydraulic cylinder unit 51. The press speed setting means 88 sets the rotary speed of the motor 41 and thus the SPM of the ram 6. The speed of the motor is controlled through a motor speed controlling device 42D.

The posture sensor unit 90 comprises a crank angle sensor 91, a ram position sensor 92 and an oil pressure sensor 93. The crank angle sensor 91 is connected to the crankshaft 31 to detect the crank angle $\theta_i$. In this embodiment, the crank angle sensor 91 is an absolute encoder having a resolution of 0.1 degree. The CPU 71 determines when the crank angle $\theta_i$ is equal to $\theta_1$ and $\theta_2$, thereby to detect the boundaries of the resting period of the ram.

The ram position sensor 92 for detecting the displacement and position of the ram 6 is an optical, magnetic linear displacement detector. Although the ram position sensor 92 is provided to indicate the ram position, it can be available in use to provide feedback for control of the flow setpoint signal Q.

Now, the operation of the embodiment will be described. Predetermined values $\theta_1$ and $\theta_2$ are set respectively in the start and stop angle setting means 82 and 83. The number of strokes per minute (30 spm in this embodiment) is set in the press speed setting means 88. A rate of change in ram speed is stored in the ROM 72 or the RAM 73. As a result, the ram stroke St is as shown by the lines L1 and L4 and the ram speed (V, $V_n$) is as shown by the lines L2 and L5, in FIG. 5.

A start command is then emitted by the control unit 70 to set the motor 41 in motion and, after a certain period of time, the clutch (46) is turned ON. Thereupon, the crankshaft 31 starts to rotate clockwise in FIG. 1, moving the slider 22 horizontally to the right. Therefore, the connection pin 12 slides downward (parallel to the Y-axis) within the vertical guide frame 23, while also moving to the right (parallel to the X-axis) together with the slider.

By this, the upper and lower links 13 and 14 rotate relative to each other about the pin 12 so as to widen the angle between the links, thereby displacing the ram downward along the Y-axis. In detail, with the increase of the crank angle $\theta$ as shown in FIG. 4, the ram makes a stroke motion St as shown by the continuous curved line L1 in FIG. 5, and the ram speed V increases and then decreases as shown by the dashed line L2. At the same time, the lower link angle $\phi$ diminishes as shown by a double dot chain line L3.

At this time, the crank angle $\theta_i$ as detected by the crank angle sensor 91 corresponds with the crank angle $\theta_1$, i.e. 145°, as set by the start angle setting means 82 (step ST10 of FIG. 3) The control unit 70 outputs the signal PR, in response to which the selector valve 61 selects port A (step ST11), thereby connecting the upper chamber 52U of the hydraulic cylinder 52 to the source 54. Simultaneously, the control unit 70 also outputs the signals Q and P to the controllers 62C and 63C for control of the flow and pressure regulating valves 62 and 63, respectively. Thus, the hydraulic cylinder unit 51 of the pressure applying device 50 is supplied with controlled oil pressure (step ST12).

In response to the pressure application, the piston 53, and the ram 6 therewith, are pushed down rapidly as shown by the dotted line L5 in FIG. 5. In this embodiment, the ram speed $V_n$ during the time of press forming is kept at a constant level of $-100$ mm/s. Thus, the ram 6 moves down smoothly at a constant rate of decline as shown by the single dot chain line L4 in FIG. 5, and performs highly accurate press forming.

As noted above, during this resting period of the ram, the lower link angle $\phi$ is a small value R of approximately 1.3° (see FIG. 5). Therefore, the ratio of the horizontal thrust T to the vertical press forming force F, given by tan $\phi$ (see FIG. 6), is the very small quantity 0.02 (2%). As a result, the ram 6 is stable in posture and remains so during the resting period. Therefore, highly accurate press forming is attainable.

The press forming force F is imparted through the upper and lower links, 13 and 14, while they are substantially collinear. As the links will not swing sideways because their connection pin 12 is fitted in the vertical guide frame 23 of the slider 22, transmission of the press forming force F, and enhanced transmission efficiency, are assured.

As described above, during the resting period of the ram, the drive/control means 60 can act on the pressure applying device 50 to cooperate with the vertical motion device 10 for highly accurate press forming. Thereafter, when the CPU 71 determines that the detected crank angle $\theta_i$ from the crank angle sensor 91 corresponds with the crank angle $\theta_2$ set by the stop angle setting means 83 (step ST13), the CPU 71 closes the flow regulating valve 62 to stop applying hydraulic pressure (step ST14). Thereupon, the ram speed $V_n$ attributable to action of the pressure applying device 50 returns to zero for a predetermined short period of time, as shown by the dotted line L4 in FIG. 5.

Subsequently, the CPU 71 outputs the signal RT in response to which the selector valve 61 opens its port C (step ST15). Thereupon, the lower chamber 52L of the cylinder 52 is supplied with oil under pressure from the source 54 through the pipe 57 and, at the same time, the oil in the upper chamber 52U is returned through the pipe 55 and the port C into the sump 67.

By this process, in addition to the increasing upward speed generated from the vertical motion device 10 as shown by the dashed line L2 in FIG. 5, the ram speed is further increased by the speed of the upwardly moving piston 53 as illustrated by the dotted line L5, whereby the ram moves abruptly upward. The resulting portion of the ram stroke St, corresponding to the released oil pressure during the return of oil to the sump 67, is illustrated by the curve L4 in FIG. 5. Thereafter, the control unit will repeat its functions in the steps ST10 to ST15, for repeated press forming operations as long as the clutch remains ON.

Although the preferred embodiment of the invention and several contemplated modifications thereof have been described in detail with reference to the accompanying drawings, it is to be understood that the invention is not limited to those. Various changes or modifications may be effected by one skilled in the art without departing from the scope or spirit in the invention.

What is claimed is:

1. A press, comprising:

a press drive;

a reciprocation unit associated with said press drive to be driven thereby in horizontal reciprocation;

a ram;

a motion direction shifting unit coupled to said reciprocation unit and said ram so as to reciprocate said ram vertically between an upper position and a lower rest position in response to horizontal reciprocation of said reciprocation unit, such that said ram remains in a state of substantial rest with respect to said shifting unit for a period of time upon reaching said rest position;

a pressure applying device for pushing said ram downward during said period of time;

sensor means for detecting that said ram is in the rest state; and a pressure drive/control means for driving said pressure applying device to apply a controlled press forming force to said ram when said sensor means detects said rest state of said ram.

2. A press as claimed in claim 1, wherein said shifting unit has a link structure and said reciprocation unit has a crank structure.

3. A press as claimed in claim 2, further comprising a press frame, said shifting unit including an upper link and a lower link, a first pin pivotally connecting said upper and lower links to each other, a second pin pivotally connecting said upper link to said pressure applying device, a third pin pivotally connecting said lower link to said ram, a slider horizontally movably mounted to said press frame, and a vertical guide frame in said slider, said first pin being vertically slideably mounted in said guide frame.

4. A press as claimed in claim 3, wherein said shifting unit further includes a sliding element connected to said first pin, said sliding element being slideably mounted in said vertical guide frame.

5. A press as claimed in claim 4, wherein said shifting unit further includes a pair of horizontal guide bars mounted to said frame, said slider being slideably mounted to said guide bars.

6. A press as claimed in claim 4, wherein said first pin is rotatably mounted to said sliding element.

7. A press as claimed in claim 3, wherein said shifting unit further includes a pair of horizontal guide bars mounted to said frame, said slider being slideably mounted to said guide bars.

8. A press as claimed in claim 3, wherein said reciprocation unit includes a crankshaft adapted to rotate in synchronism with said press drive and including an eccentric member, a connecting rod mounted to said eccentric member, and a fourth pin pivotally connecting said connecting rod to said slider.

9. A press as claimed in claim 3, wherein said pressure applying device includes a cylinder unit and a hydraulic supply system, said hydraulic supply system being provided on said frame, said cylinder unit including a cylinder and a piston and being pivotally connected by said second pin to said upper link.

10. A press as claimed in claim 2, wherein said reciprocation unit includes a crankshaft adapted to rotate in synchronism with said press drive and including an eccentric member, a connecting rod mounted to said eccentric member, and a pin pivotally connecting said connecting rod to said shifting unit.

11. A press as claimed in claim 1, further comprising a press frame, said shifting unit including an upper link and a lower link, a first pin pivotally connecting said upper and lower links to each other, a second pin pivotally connecting said upper link to said pressure applying device, a third pin pivotally connecting said lower link to said ram, a slider horizontally movably mounted to said press frame, and a vertical guide frame in said slider, said first pin being vertically slideably mounted in said guide frame.

12. A press as claimed in claim 11, wherein said shifting unit further includes a sliding element connected to said first pin, said sliding element being slideably mounted in said vertical guide frame.

13. A press as claimed in claim 12, wherein said shifting unit further includes a pair of horizontal guide bars mounted to said press frame, said slider being slideably mounted to said guide bars.

14. A press as claimed in claim 11, wherein said shifting unit further includes a pair of horizontal guide bars mounted to said press frame, said slider being slideably mounted to said guide bars.

15. A press as claimed in claim 11, wherein said reciprocation unit includes a crankshaft adapted to rotate in synchronism with said press drive and including an eccentric member, a connecting rod mounted to said eccentric member, and a fourth pin pivotally connecting said connecting rod to said slider.

16. A press as claimed in claim 1, wherein said reciprocation unit includes a crankshaft adapted to rotate in synchronism with said press drive and including an eccentric member, a connecting rod mounted to said eccentric member, and a pin pivotally connecting said connecting rod to said shifting unit.

17. A press as claimed in claim 1, wherein said pressure control/drive means includes a fluid supply system, said pressure applying device being driven through the fluid in said system, a selector valve for directing fluid flow in said system, a flow regulating valve for regulating a rate of fluid flow in said system to automatically control the speed of said ram during said period of time when said ram is in said rest state, a pressure regulating valve which is responsive to a pressure setpoint signal to regulate fluid pressure in said system, and a control unit, said control unit outputting the pressure setpoint signal to control said pressure regulating valve.

18. A press as claimed in claim 1, wherein said pressure control/drive means includes a fluid supply system, said pressure applying device being driven through the fluid in said system, said sensor means includes a crank angle sensor for detecting a crank angle of said reciprocation unit, a position sensor for detecting a vertical position of said ram, and a fluid pressure sensor for detecting a fluid pressure in said fluid supply system.

19. A press, comprising:

a frame;

a press drive on said frame;

a ram;

a vertical motion device mounted on said frame, including a reciprocation unit and a shifting unit, said reciprocation unit associated with said press drive to be driven thereby in continuous reciprocation, said shifting unit coupled to said reciprocation unit and said ram so as to reciprocate said ram vertically between an upper position and a lower rest position in response to the reciprocation of said reciprocation unit, such that said ram remains in a state of substantial rest with respect to said shifting unit for a period of time during the continuous reciprocation of said reciprocation unit, upon reaching said rest position;

a pressure applying device, mounted on said frame and coupled to said shifting unit, for pushing said ram and a portion of said shifting unit downward during said period of time;

sensor means for detecting that said ram is in the rest state; and a pressure drive/control means for driving said pressure applying device to apply a controlled press forming force to said ram when said sensor means detects said rest state of said ram.

20. A press, comprising:

a press frame;

a press drive mounted to said press frame;

a reciprocation unit having a crank structure, associated with said press drive to be driven thereby in horizontal reciprocation, said reciprocation unit including a crankshaft adapted to rotate in synchronism with said press drive and including an eccentric member and a connecting rod mounted to said eccentric member;

a ram;

a motion direction shifting unit, coupled to said reciprocation unit and said ram so as to reciprocate said ram vertically between an upper position and a lower rest position in response to horizontal reciprocation of said reciprocation unit, such that said ram remains in a state of substantial rest with respect to said shifting unit for a period of time upon reaching said rest position, said shifting unit having a link structure, including an upper link, a lower link, and a first pin pivotally connecting said upper and lower links to each other, a second pin pivotally connecting said lower link to said ram, a slider horizontally movably mounted to said press frame, and a vertical guide frame in said slider, said first pin being vertically slideably mounted in said guide frame, a third pin pivotally connecting said connecting rod to said slider;

a pressure applying device for pushing said ram downward during said period of time, said pressure applying device including a cylinder unit, said cylinder unit including a cylinder mounted to said press frame and a piston in said cylinder pivotally connected by a fourth pin to said upper link;

sensor means for detecting that said ram is in the rest state; and a pressure drive/control means for driving said pressure applying device to apply a controlled press forming force to said ram when said sensor means detects said rest state of said ram, said pressure drive/control means including a hydraulic fluid supply system in fluid communication with said cylinder, a controllable selector valve for directing a flow of fluid in said system into said cylinder, a controllable flow regulating valve for regulating a rate of flow of the fluid into said cylinder, and a control unit, said control unit responsive to a signal from said sensor means to control said valves, and thereby the speed of said ram, during said period of time that said ram is in said rest state.

* * * * *